US007942023B2

(12) United States Patent
Kanazawa

(10) Patent No.: US 7,942,023 B2
(45) Date of Patent: May 17, 2011

(54) DRUM TYPE WASHING MACHINE

(75) Inventor: Naoki Kanazawa, Osaka (JP)

(73) Assignee: Samsung Electronics Co., Ltd., Suwon-Si (KR)

( * ) Notice: Subject to any disclaimer, the term of this patent is extended or adjusted under 35 U.S.C. 154(b) by 210 days.

(21) Appl. No.: 12/343,590

(22) Filed: Dec. 24, 2008

(65) Prior Publication Data

US 2009/0199598 A1 Aug. 13, 2009

(30) Foreign Application Priority Data

Dec. 27, 2007 (JP) ..... 2007-335805

(51) Int. Cl.
*D06F 33/02* (2006.01)

(52) U.S. Cl. ..... 68/12.04; 68/12.02

(58) Field of Classification Search ..... 68/12.02, 68/12.04

See application file for complete search history.

(56) References Cited

U.S. PATENT DOCUMENTS

| | | | | |
|---|---|---|---|---|
| 4,779,430 | A * | 10/1988 | Thuruta et al. | 68/12.04 |
| 5,208,931 | A * | 5/1993 | Williams et al. | 8/159 |
| 6,029,300 | A * | 2/2000 | Kawaguchi et al. | 8/159 |
| 6,495,980 | B2 * | 12/2002 | Cho et al. | 318/400.02 |
| 7,627,918 | B2 * | 12/2009 | Lee | 8/158 |

FOREIGN PATENT DOCUMENTS

| | | | |
|---|---|---|---|
| JP | 62-192197 | * | 8/1987 |
| JP | 06-039179 | * | 2/1994 |
| JP | 10-043471 | * | 2/1998 |
| JP | 10-201989 | | 8/1998 |
| JP | 2002-126390 | | 5/2002 |
| JP | 2008-43638 | | 2/2008 |
| KR | 10-2002-0025314 | A | 4/2002 |
| KR | 2004100532 | * | 12/2004 |

OTHER PUBLICATIONS

European Patent Office 1 428 925 Jun. 2004.*
Korean Office Action issued Aug. 30, 2010 in corresponding Korean Patent Application 10-2008-0128560.

* cited by examiner

*Primary Examiner* — Frankie L Stinson
(74) *Attorney, Agent, or Firm* — Staas & Halsey LLP

(57) ABSTRACT

Disclosed herein are a drum type washing machine and a control program therefore. The washing machine includes a control mechanism to control a motor. The control mechanism includes a torque control unit to perform torque addition processes of adding pulse type torque during only a period for which a drum makes one rotation in a uniform torque control state in which torque of the motor is uniformly controlled at least two times and to perform the second torque addition process after n+0.5 rotations of the drum (n is an integer not less than 1) on the basis of the first torque addition process, and a weight calculation unit to calculate an average value of rotational accelerations of the motor at the respective torque addition processes and to calculate a weight of laundry received in the drum based on the average value.

3 Claims, 5 Drawing Sheets

DRUM TYPE WASHING MACHINE

CROSS-REFERENCE TO RELATED APPLICATION

This application claims the benefit of Japanese Patent Application No. 2007-335805, filed on Dec. 27, 2007 in the Japanese patent Office, the disclosure of which is incorporated herein by reference.

BACKGROUND OF THE INVENTION

1. Field of the Invention

The present invention relates to a drum type washing machine that is capable of calculating the weight of laundry (hereinafter, also referred to as 'laundry amount') received in a drum and a program to calculate the laundry amount.

2. Description of the Related Art

To optimally set the amount of water necessary for respective processes of washing or the rotation speed of a drum, it is important to calculate laundry amount with high accuracy. In the past, an equation of motion was solved using voltage of a motor or rotational acceleration of a drum to calculate inertia on the drum and thus calculate the weight of laundry (Japanese Patent No. 3641581).

However, the voltage of the motor and the rotation speed of the drum used in the calculation method include an error due to a windage loss, a mechanical loss, an effect by contact friction between laundry articles, an effect by the fluctuation of power supply voltage or a load, an effect by the difference between machine bodies of washing machines due to bearing friction, and unbalance of laundry clinging to the drum, with the result that it is difficult to calculate laundry amount with high accuracy. Also, pulse measurement using a hole integrated circuit (IC) is generally performed to measure the rotation speed of the drum with low costs. In this case, however, a determination error may be generated due to the non-uniformity of the pulse.

For this reason, the measurement may be repeated several times to remove such an error factor and calculate laundry amount with high accuracy. In this case, however, the measurement may be carried out for a long time, and a resonance-related problem may occur.

Inventors of the present application proposed an invention that is capable of solving some of the above-mentioned problems, of which a patent application has been filed with the Japanese Patent Office and accorded Japanese Patent Application No. 2006-224117.

This invention discloses a method of calculating the weight of laundry considering a fact that the unbalance of laundry amount is dominant in the measurement error, particularly at a low-speed rotation. This method calculates inertia by an equation of motion using an average rotational acceleration during a period for which a drum makes one rotation, thereby canceling the effect of unbalance torque with respect to rotation speed generated due to the unbalance of laundry as shown in FIG. 1 and, at the same time, achieving the measurement of laundry amount within a short time without causing resonance.

More specifically, an equation of rotational motion related to a rotary drum considering the unbalance torque in the rotational direction due to the cling of laundry to the drum by the bias of the laundry may be represented by Equation 1 below.

[Equation 1]

$$T + Mg\sin\omega t = J\frac{d\omega}{dt} + D\omega \tag{1}$$

Where, T is torque, M is unbalance, g is the acceleration of gravity, t is time, J is inertia, D is the coefficient of viscosity, and ω is rotation speed. The mechanical loss is omitted.

Opposite sides of Equation 1 are multiplied by dt and integrated with one rotation to obtain Equation 2.

[Equation 2]

$$\begin{aligned} &\int (T + Mg\sin\omega t)dt = \int\left(J\frac{d\omega}{dt} + D\omega\right)dt \\ &T\Delta t + Mg\int_0^{2\pi}\sin\theta d\theta = J\int_{\omega 1}^{\omega 2}(1)\,d\omega + D\int\omega d\omega\left(\frac{dt}{d\omega}\right) \\ &T\Delta t = J\Delta\omega + \frac{D}{2}(\omega_2^2 - \omega_1^2)\frac{\Delta t}{\Delta\omega} \end{aligned} \tag{2}$$

Where, Δt is time required for one rotation, $\omega_1$ is initial speed, $\omega_2$ is final speed, and Δω is the change of speed during one rotation ($\Delta\omega=\omega_2-\omega_1$).

The existence of unbalance M is canceled through the integration with one rotation by Equation 1, and therefore, it can be seen that the effect of the unbalance of laundry with respect to torque is excluded from this calculation method.

Subsequently, Equation 2 is solved with respect to inertia J, and the torque is divided into normal operation torque τ and acceleration torque Δτ, such that T is expressed as τ+Δτ, to obtain Equation 3.

[Equation 3]

$$J = (\tau + \Delta\tau)\frac{\Delta t}{\Delta\omega} - D\left(\frac{\omega_1}{\Delta\omega} + \frac{1}{2}\right)\Delta t \tag{3}$$

Here, τ+Δτ is the amount of torque manipulated, and Δt, Δω, and $\omega_1$ are the amounts of change due to the acceleration measured. The coefficient of viscosity D may be uniformly maintained to calculate inertia H.

The above-mentioned invention is characterized by very accurate measurement of Δt and Δω. However, the initial speed $\omega_1$ included in Equation 3 changes due to unbalance M immediately before the start of acceleration, as shown in FIGS. 2 and 3, with the result that it is difficult to improve the accuracy in calculating the weight of laundry although the measurement is carried out merely several times to take an average.

To improve the accuracy in calculating the weight of laundry, it is necessary to uniformly maintain the initial speed $\omega_1$ every time of measurement. To uniformly maintain the initial speed $\omega_1$, it is necessary to uniformly control voltage $V_1$ (equivalent to torque T) applied to the motor.

In practice, however, it is necessary to specify the position of the unbalance M of the laundry to equalize the initial speed $\omega_1$ and the voltage $V_1$ immediately before every acceleration. Furthermore, many errors may be included in the calculation.

SUMMARY OF THE INVENTION

Therefore, it is an aspect of the invention to provide a drum type washing machine that is capable of calculating the weight of laundry within a very short time with high accuracy, while achieving the characteristics of the invention as previously described, without being affected by speed at the time of starting the measurement.

In accordance with one aspect, the present invention provides a drum type washing machine including a drum rotatably supported around a horizontal or inclined rotary shaft, a motor to rotate the drum, and a control mechanism to control the motor, wherein the control mechanism includes a torque control unit to perform torque addition processes of adding pulse type torque during only a period for which the drum makes one rotation in a uniform torque control state in which torque of the motor is uniformly controlled k times (k is an integer not less than 2) and, at the same time, to set a rotation angle of the drum at points of time when the respective torque addition processes are carried out to be one obtained by equally dividing 360 degrees into k pieces, and a weight calculation unit to calculate an average value of rotational accelerations of the motor at the respective torque addition processes and, at the same time, to calculate a weight of laundry received in the drum based on the average value.

In accordance with another aspect, the present invention provides a control program for a drum type washing machine including a drum rotatably supported around a horizontal or inclined rotary shaft, a motor to rotate the drum, and a control mechanism to control the motor, wherein the control program enables the control mechanism to function as a torque control unit to perform torque addition processes of adding pulse type torque during only a period for which the drum makes one rotation in a uniform torque control state in which torque of the motor is uniformly controlled k times (k is an integer not less than 2) and, at the same time, to set a rotation angle of the drum at points of time when the respective torque addition processes are carried out to be one obtained by equally dividing 360 degrees into k pieces, and a weight calculation unit to calculate an average value of rotational accelerations of the motor at the respective torque addition processes and, at the same time, to calculate a weight of laundry received in the drum based on the average value.

In the above-stated construction, it is possible to cancel the effect of the rotation speed of the drum at the time of starting the measurement, thereby calculating the weight of laundry received in the drum with high accuracy. Also, it is possible to calculate the weight of laundry within a short measuring time sufficient to rotate the drum several times (for example, less than 10 times), thereby preventing the measurement from being affected by resonance of the drum.

In accordance with another aspect, the present invention provides a drum type washing machine including a drum rotatably supported around a horizontal or inclined rotary shaft, a motor to rotate the drum, and a control mechanism to control the motor, wherein the control mechanism includes a torque control unit to perform torque addition processes of adding pulse type torque during only a period for which the drum makes one rotation in a uniform torque control state in which torque of the motor is uniformly controlled at least two times and, at the same time, to perform the second torque addition process after n+0.5 rotations of the drum (n is an integer not less than 1) on the basis of the first torque addition process, and a weight calculation unit to calculate an average value of rotational accelerations of the motor at the respective torque addition processes and, at the same time, to calculate a weight of laundry received in the drum based on the average value.

In accordance with a further aspect, the present invention provides a control program for a drum type washing machine including a drum rotatably supported around a horizontal or inclined rotary shaft, a motor to rotate the drum, and a control mechanism to control the motor, wherein the control program enables the control mechanism to function as a torque control unit to perform torque addition processes of adding pulse type torque during only a period for which the drum makes one rotation in a uniform torque control state in which torque of the motor is uniformly controlled at least two times and, at the same time, to perform the second torque addition process after n+0.5 rotations of the drum (n is an integer not less than 1) on the basis of the first torque addition process, and a weight calculation unit to calculate an average value of rotational accelerations of the motor at the respective torque addition processes and, at the same time, to calculate a weight of laundry received in the drum based on the average value.

In the above-stated construction, the second torque addition process is carried out after n+0.5 rotations of the drum on the basis of the first torque addition process. Consequently, it is possible to cancel the effect of the rotation speed of the drum at the time of starting the measurement, thereby calculating the weight of laundry received in the drum with high accuracy.

Also, it is sufficient to perform the measurement within a very short time a few measuring times, e.g., at least twice, with the result that the measurement is hardly affected by disturbance, such as resonance of the drum.

Also, similarly to the previous mentioned invention, the calculation is carried out with a period for which the motor makes one rotation being treated as one unit. Consequently, it is possible to cancel the effect of torque fluctuation of the motor due to the unbalance of laundry in the drum.

Since the weight of laundry is calculated within a short time with high accuracy, it is possible to determine the quality of laundry based on water content or perform accurate washing control based on laundry amount, thereby being used in indirect detection of the amount of water injected.

Also, the detection of an rotation angle is necessary for only a high resolution of one rotation or half rotations. Consequently, it is possible to calculate the weight of laundry with sufficiently high accuracy even using, for example, an inexpensive hole IC.

Also, only small amount calculation, such as average calculation, is carried out, and therefore, it is possible to easily mount the control mechanism in the washing machine.

The control mechanism may alternately perform a uniform control of speed and a uniform control of torque. When the torque of the motor in the uniform torque control state is obtained by averaging torques applied to the drum during a period for which the drum makes one rotation immediately before the uniform control of torque is carried out, it is possible to remove an error factor caused by the unbalance of the normal torque before acceleration at the first torque addition process and the second torque addition process, thereby further improving the accuracy in calculating the weight of laundry.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
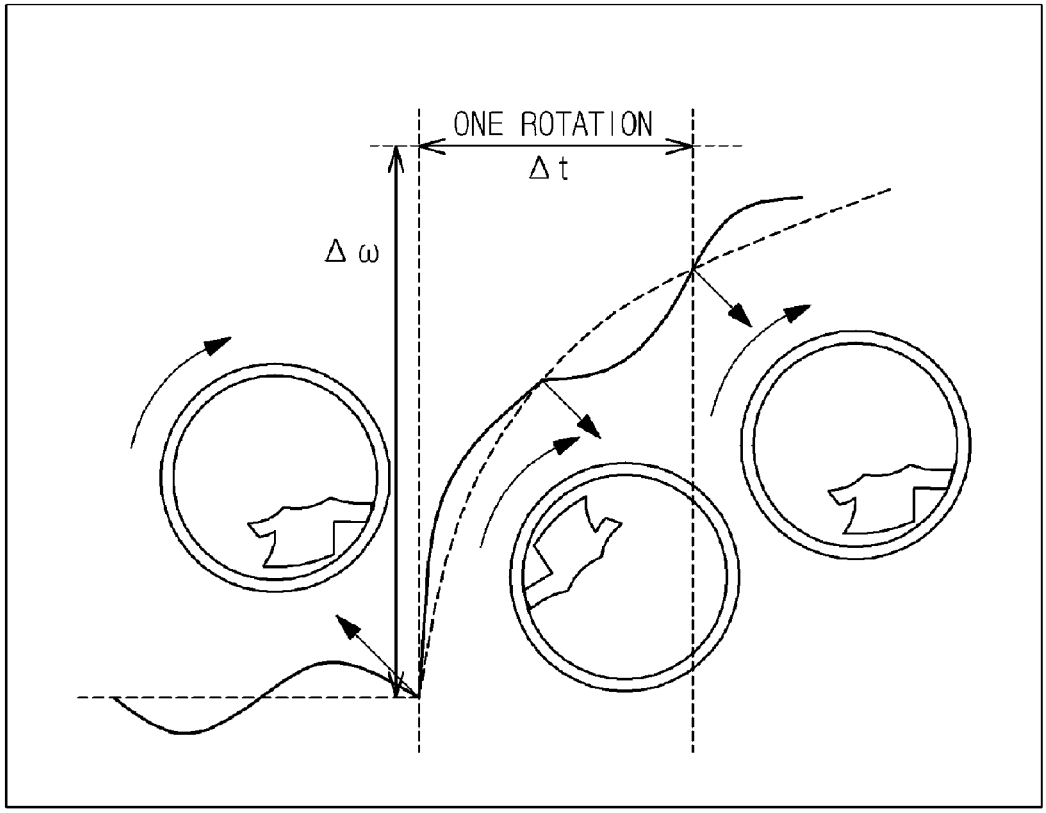
FIG. 1 is a schematic view illustrating the change of speed due to the unbalance of laundry.

Reference will now be made in detail to the embodiment of the present invention, examples of which are illustrated in the accompanying drawings, wherein like reference numerals refer to like elements throughout. The embodiment is described below to explain the present invention by referring to the figures.

Figure 4:
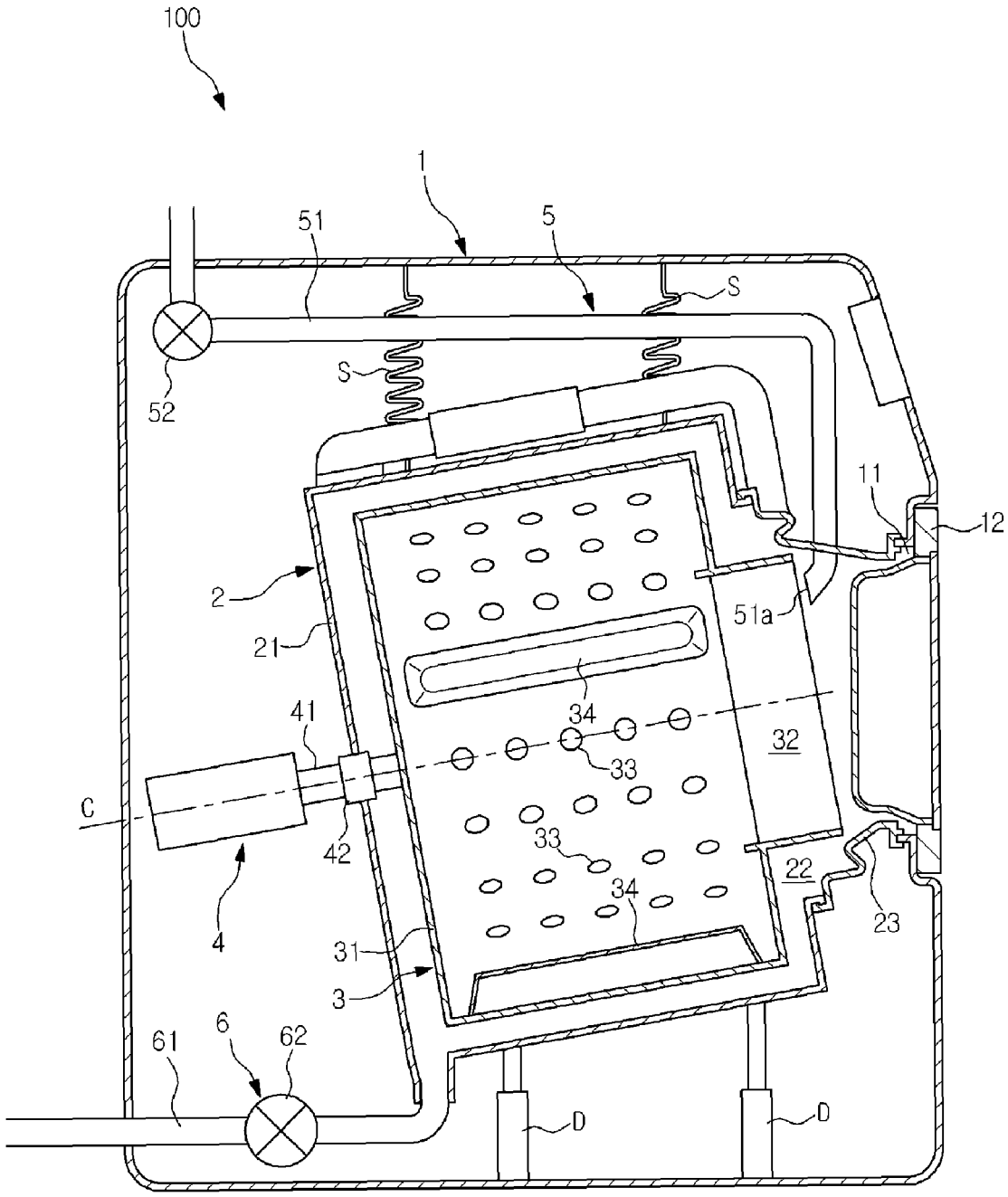
FIG. 4 is a longitudinal sectional view schematically illustrating the interior structure of a washing machine according to the embodiment of the present invention.

FIG. 4 is a longitudinal sectional view schematically illustrating the interior structure of a washing machine 100 according to an embodiment of the present invention. Reference numeral 1 indicates a hollow machine body. At the use end side (hereinafter, also referred to as 'the front side') of the machine body 1 are provided an inlet port 11 to allow laundry to be let in therethrough and an openable and closable cover 12 to close the inlet port 11. In the machine body 1 is mounted a water tub 2. In the water tub 2 is mounted a drum 3.

The water tub 2 is formed approximately in the shape of a cylinder having a rear end blocked by a bottom plate 21 and an opening 22 formed at a front end thereof. A central axis C of the water tub 2 is disposed horizontally or inclined to a horizontal line such that the front side of the water tub 2 is slight higher than the rear side of the water tub 2. The water tub 2 is shakably supported by dampers D and elastic bodies S. Also, the opening 22 is connected to the inlet port 11 of the machine body 1 through a flexible cylindrical body 23.

The drum 3 is formed in the shape of a cylinder much less than the water tub 2. In the same manner as the water tub 2, the drum 3 has a rear end blocked by a bottom plate 31 and an opening 32 formed at a front end thereof. A plurality of holes 33 are formed through the drum 3 in the thickness direction such that water is introduced from the water tub 2 to the drum 3 through the holes 33. Also, a plurality (three) of lifters 34 are provided at the inner circumference of the drum. Each of the lifters 34 is formed in the shape of a protrusion to lift laundry while the laundry is hung thereon.

Also, outside the bottom plate 21 of the water tub 2 is mounted a motor 4 to rotate, for example, the drum 3. The motor 4 has a rotary shaft 41 extending through the bottom plate 21 via a bearing 42. The rotary shaft 41 is fixed to the bottom plate 32 of the drum 3.

Reference numeral 5 indicates a water supply mechanism 5 to supply wash water. The water supply mechanism 5 includes a water supply pipe 51 connected to an external water pipe and an electronic opening and closing valve 52 mounted on the water supply pipe 51. The water supply pipe 51 has a tip end injection port 51*a* facing the opening 32 of the drum 3 such that water is directly injected to laundry in the drum 3 through the injection port 51*a*.

Reference numeral 6 indicates a drainage mechanism to drain wash water from the water tub 2 and the drum 3 to the outside. The drainage mechanism 6 includes a drainage pipe 61 connected to the lowermost part of the water tub 2, i.e., the lower part of the rear end of the water tub 2, and an electronic opening and closing valve 62 mounted on the drainage pipe 61.

In addition, the washing machine further includes a control mechanism 7 (not shown in FIG. 4) provided in the machine body 1 to control the electronic opening and closing valve 52, the electronic opening and closing valve 62, or the motor 4, calculate the weight of laundry in the drum, and automatically perform a washing operation or a spin-drying operation.

At least in the hardware construction, the control mechanism 7 includes a central processing unit (CPU), a memory, and various drive circuits. According to programs stored in the memory, the CPU and peripherals cooperate with one another to exhibit various functions.

Figure 5:
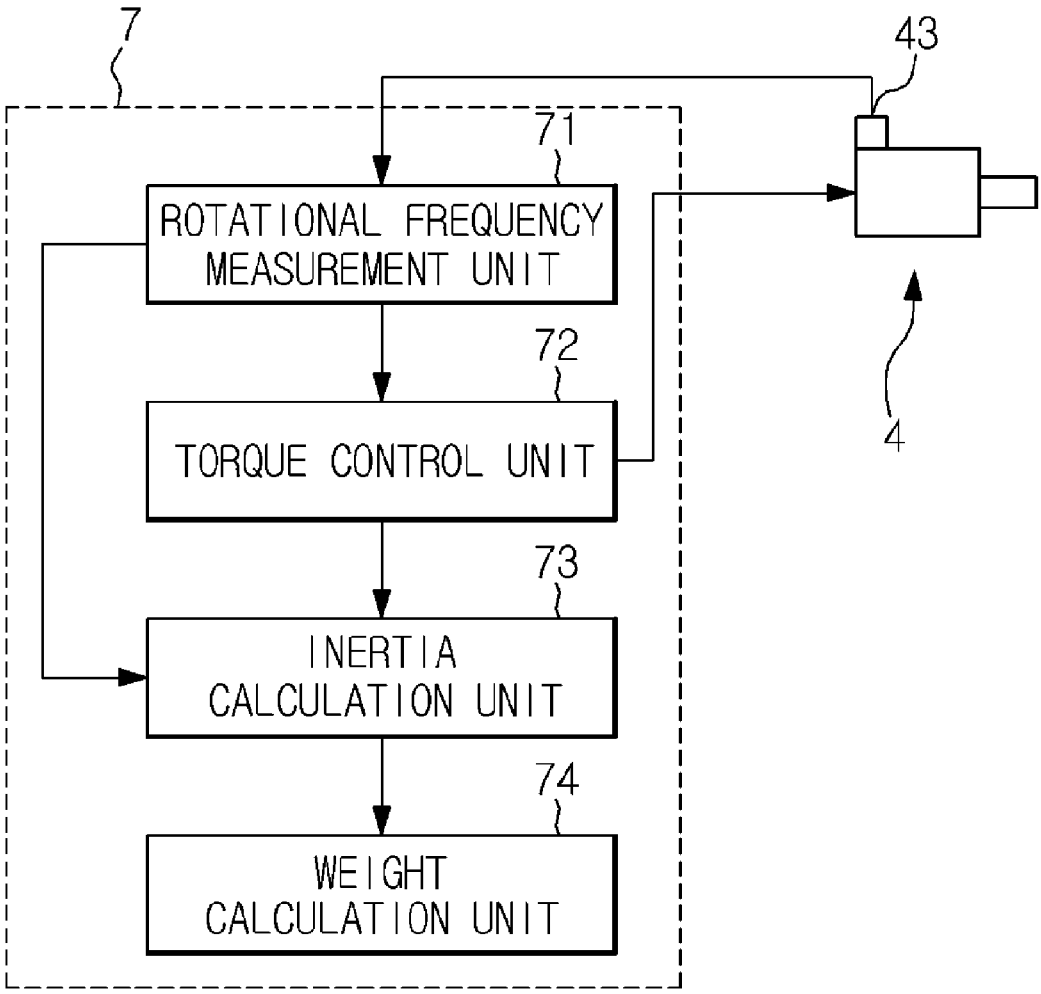
FIG. 5 is a function block diagram of a control mechanism in a washing operation according to the embodiment of the present invention.

In this embodiment, as shown in a function block diagram of FIG. 5, the control mechanism 7 is programmed to exhibit functions at least as a rotational frequency measurement unit 71, a torque control unit 72, an inertia calculation unit 73, and a weight calculation unit 74.

The rotational frequency measurement unit 71 measures the number of rotations and rotational acceleration of the motor 4, for example, using a rotation angle sensor 43, such as a hole IC, to sense the position of a rotor of the motor 4 and output a pulse signal. More specifically, the rotational frequency measurement unit 71 measures time between pulses outputted from the rotation angle sensor 43 to calculate the number of rotations or the rotational acceleration of the motor 4.

The torque control unit 72 controls voltage applied to the motor to uniformly maintain, increase, or decrease the speed of the drum necessary to calculate the weight of laundry. In this embodiment, a torque addition process of adding pulse type torque during only a period for which the drum makes one rotation in a state in which the speed is uniformly controlled is carried out twice in calculating the weight of laundry. The period for which the drum makes one rotation is determined from the number of rotations outputted from the rotational frequency measurement unit 71.

The inertia calculation unit 73 acquires average rotational acceleration during a period for which the drum makes one rotation from the rotational frequency measurement unit 71, acquires torque commanded to the motor during the torque addition process from the torque control unit 72, and calculates inertia of laundry in the drum from an equation of rotational motion.

The weight calculation unit 74 averages the calculation results of inertia J at the respective torque addition processes calculated by the inertia calculation unit 73 to calculate the weight of laundry.

Figure 2:
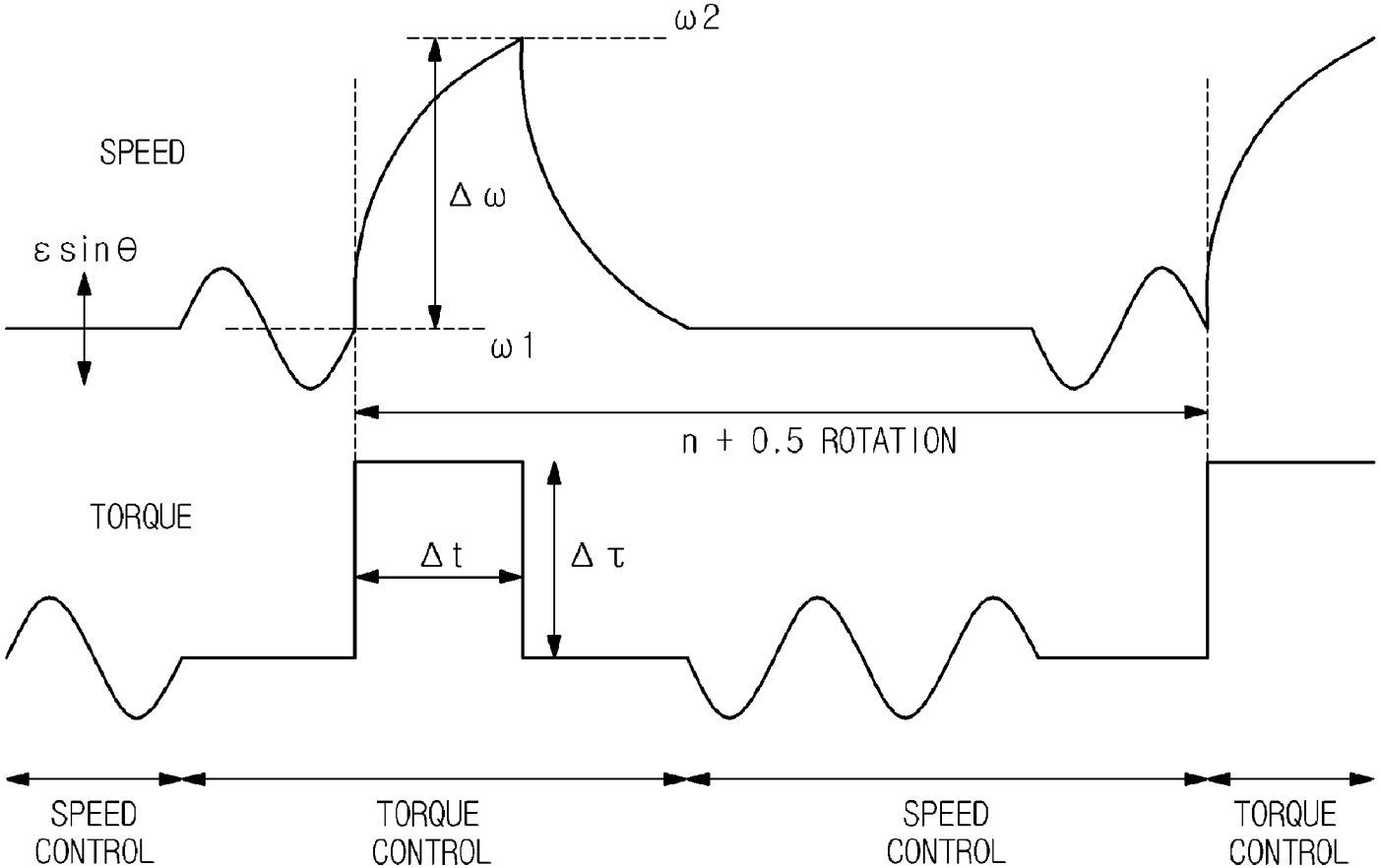
FIG. 2 is a schematic view illustrating speed and torque control for calculation of laundry weight according to an embodiment of the present invention.
Figure 3:
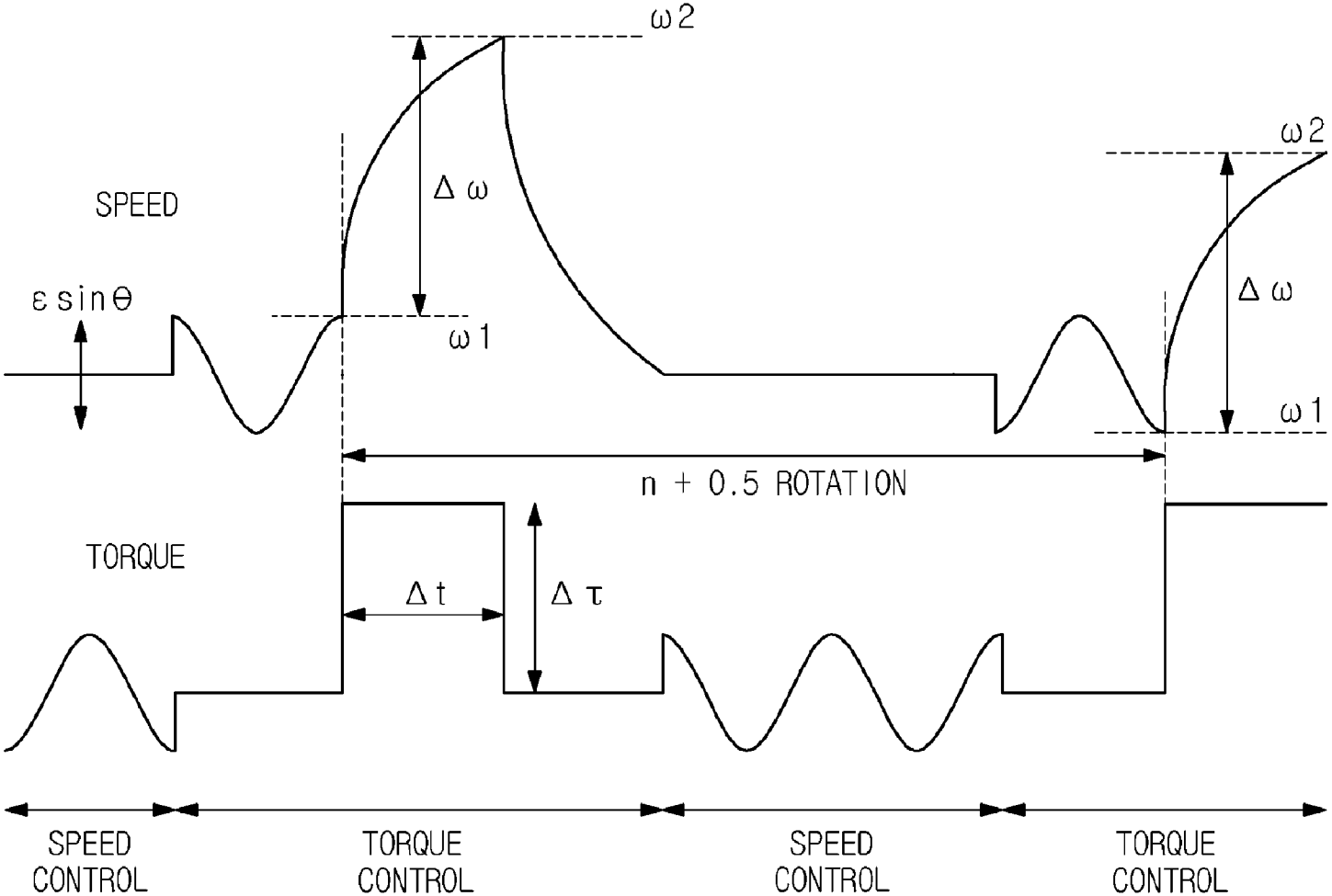
FIG. 3 is another schematic view illustrating speed and torque control for calculation of laundry weight according to the embodiment of the present invention.

Hereinafter, a method of calculating the weight of laundry by the respective components of the control mechanism 7 and motor control therefore will be described in detail with reference to FIGS. 2 and 3.

First, the torque control unit 72 performs a uniform control of speed to rotate the motor at a uniform speed. The rotation speed of the motor at this time is referred to as a normal speed $\omega_{ave}$.

After performing the uniform control of speed for a predetermined time, the torque control unit 72 performs the conversion from the uniform control of speed to a uniform control of torque. At this time, a normal torque $\tau$ commanded to the motor is set to be an average value of torques commanded to the motor during a period for which the drum makes one rotation immediately before the conversion is carried out from the uniform control of speed to the uniform control of torque.

Subsequently, as a first torque addition process, the torque control unit 72 adds an acceleration torque $\Delta\tau$ to the normal torque $\tau$ during only a period for which the drum makes one rotation a predetermined time after the conversion into the uniform control of torque.

The inertia calculation unit 73 calculates the amount of inertia $J_1$ at the first torque addition process from average acceleration and commanded torque, and stores the calculated amount of inertia in the weight calculation unit 74.

When being informed that the drum has made one rotation from the rotational frequency measurement unit 71, the torque control unit 72 performs the conversion from the uniform control of torque to a uniform control of speed and controls the rotation speed of the motor to return to the normal speed $\omega_{ave}$.

After the rotation speed of the motor has return to the normal speed $\omega_{ave}$, the torque control unit 72 performs the conversion from the uniform control of speed to a uniform control of torque. At this time, the normal torque $\tau$ is set to be an average value of torques commanded to the motor during a period for which the drum makes one rotation immediately before the conversion is carried out from the uniform control of speed to the uniform control of torque.

When the rotational frequency measurement unit 71 has detected that n+0.5 rotations had been made from a start point of the first torque addition process, the acceleration torque $\Delta\tau$ is added to the normal torque $\tau$, in the same manner as the first torque addition process, and a second torque addition process is carried out.

The inertia calculation unit 73 calculates inertia at the second torque addition process from average acceleration at the second torque addition process and commanded torque, and stores the calculated inertia in the weight calculation unit 74.

Finally, the weight calculation unit 74 averages the measured values of inertia at the first and second torque addition processes, stored therein, to calculate an average amount of inertia J from which an error due to acceleration timing has been canceled and calculate the weight of laundry.

Hereinafter, an explanation will be given of that the error due to the acceleration timing of the drum may be canceled by averaging the amount of inertia $J_1$ at the first torque addition process and the amount of inertia $J_2$ at the second torque addition process starting after the n+0.5 rotations from the start point of the first torque addition process.

In the following description, the change $\Delta\omega$ of speed during one rotation and time $\Delta t$ required for one rotation, which are measured values at the first and second torque addition processes, are treated as the same value at the first and second torque addition processes for convenience sake.

An unbalance torque of Mg sin $\theta$ is applied to a rotational body by the existence of unbalance weight M generated due to the bias of laundry in the drum, with the result that rotation speed $\omega_1$ at acceleration timing also changes. This may be represented by the following equation.

[Equation 4]

$$\omega_1=\omega_{ave}+\epsilon \sin \theta_{s1} \tag{4}$$

Where, $\omega_{ave}$ is an average rotation speed during uniform control of speed, and $\theta_{s1}$ is a rotation angle of the motor when acceleration starts at the first torque addition process.

From Equation 4 and Equation 3 to find inertia, previously mentioned in the section 'the description of the related art,' an error $J_{e1}$ of inertia due to the nonuniformity of the acceleration start speed may be represented by the following equation.

[Equation 5]

$$J_{e1} = -D\varepsilon\sin\theta_{s1} \cdot \frac{\Delta t}{\Delta\omega} \tag{5}$$

The second torque addition process starts after the n+0.5 rotations from the start point of the first torque addition process. Consequently, a rotation angle $\theta_{s2}$ when the second torque addition process starts may be represented by the following equation.

[Equation 6]

$$\theta_{s2}=\theta_{s1}+2\pi n+\pi \tag{6}$$

From Equation 6, an error $J_{e2}$ of inertia due to the nonuniformity of the acceleration start speed at the second torque addition process may be represented by the following equation.

[Equation 7]

$$J_{e2} = -D\varepsilon\sin(\theta_{s1} + \pi) \cdot \frac{\Delta t}{\Delta\omega} \tag{7}$$

Therefore, when the weight calculation unit 74 takes an average value of the amounts of inertia, an error therebetween may be canceled as follows by Equation 5 and Equation 6.

[Equation 8]

$$J_{e1} + J_{e2} = -D\varepsilon\sin\theta_{s1} \cdot \frac{\Delta t}{\Delta\omega} + D\varepsilon\sin\theta_{s1} \cdot \frac{\Delta t}{\Delta\omega} = 0 \tag{8}$$

Therefore, as long as the rotation angles $\theta_{s1}$ and $\theta_{s2}$ of the drum at the time of staring acceleration satisfy Equation 6, i.e., it is possible to detect that the relative angle between $\theta_{s1}$ and $\theta_{s2}$ has the difference corresponding to the n+0.5 rotations, it can be seen that it is possible to cancel the error due to the nonuniformity of the acceleration start speed although it is not possible to accurately detect the respective rotation angles.

Also, the normal torque $\tau$ commanded to the motor is obtained by averaging torques applied during a period for which the drum makes one rotation immediately before the conversion is carried out from the uniform control of speed to the uniform control of torque. Consequently, the normal torque $\tau$ and the normal speed $\omega_{ave}$ at the first torque addition process become equal to the normal torque $\tau$ and the normal speed $\omega_{ave}$ at the second torque addition process.

From the average of the amount of inertia J at the first torque addition process and the amount of inertia J at the second torque addition process satisfying $\tau$=D $\omega_{ave}$ in a state of the uniform rotation speed and canceling the error due to the nonuniformity of the rotation angle of the motor at the time of starting acceleration as previously described, the following equation may be derived from Equation 3 only using the change $\Delta\omega$ of speed during one rotation, the acceleration torque $\Delta\tau$, and time $\Delta t$ required for one rotation.

[Equation 9]

$$< J > = \left(\frac{\Delta\tau}{\Delta\omega} - \frac{D}{2}\right)\Delta t \quad (9)$$

It can be seen that the measurement is carried out during a period for which the drum makes one rotation, and therefore, only the acceleration torque Δτ, of which an accurate value can be obtained, the change Δω of speed during one rotation, and time Δt required for one rotation are left, whereby it is possible to calculate the average inertia J with high accuracy and to calculate the weight of laundry with high accuracy.

Also, it can be seen from Equation 9 that, when the effect of coefficient of viscosity D is reduced to shorten the time Δt required for one rotation, it is possible to more accurately make the calculation.

In the drum type washing machine and the control program for the drum type washing machine according to this embodiment with the above-stated construction, it is possible to cancel the unbalance due to the bias of laundry in the drum or the effect of the rotation speed at the time of starting the measurement, thereby calculating the weight of the laundry within a short time with high accuracy.

Also, it is possible to calculate the weight of laundry more accurately than a conventional method by performing the measurement only twice, thereby shortening the measurement time.

Since the measurement is carried out a few number of measuring times, e.g., twice, within a very short time, it is possible to prevent the occurrence of disturbance due to the resonance of the drum, for example, during the measurement, thereby calculating the weight of laundry with extremely high accuracy.

Since the weight of laundry is calculated with high accuracy, it is possible to detect unbalance, for example, based on the calculated weight of the laundry. Consequently, it is possible to detect the bias of the laundry, causing noise during spin-drying, and to solve the bias of the laundry, thereby reducing noise.

Also, it is not necessary to accurately acquire the unbalance position due to the bias of laundry in the drum but it is sufficient to detect a sufficient angle using a detector having a low resolution of one rotation or half rotations. Consequently, it is possible to calculate the weight of laundry simply by a conventional inexpensive microprocessor counting pulses from an inexpensive detector, such as a hole IC.

Furthermore, only the small amount calculation, such as average calculation, is carried out, and therefore, it is possible to easily mount the control mechanism in the washing machine.

Since the normal torque at each torque addition process is set to be an average value of torques applied to the motor during a period for which the drum makes one rotation immediately before the conversion is carried out from the uniform control of speed to the uniform control of torque, as represented by Equation 9, the item of the normal torque τ is not included in the final result of calculation, i.e., the result of the average inertia J, and therefore, the normal torque τ does not become an error factor. Only the acceleration torque Δτ, which can be measured with high accuracy, the change Δω of speed during one rotation, and time Δt required for one rotation affect the calculation result, and therefore, it is possible to further improve calculation accuracy.

The present invention is not limited to the illustrated example or embodiment.

For example, the torque control unit may perform torque addition processes k times (for example, not less than three times and less than ten times), and, at the same time, the rotation angle of the drum at points of time when the respective torque addition processes are carried out may be set to be one obtained by equally dividing 360 degrees into k pieces. That is, the $i^{th}$ torque addition process may be carried out after n+m/k rotations on the basis of the first torque addition process. Where, n is an integer not less than 1 and may be the same at the respective $i^{th}$ torque addition processes, and m is an integer not greater than k−1 and may be different at the respective $i^{th}$ torque addition processes.

The torque addition processes may be carried out a number of times corresponding to a multiple of two or three.

More specifically, the torque addition processes may be carried out three times, and the rotation angles of the drum at the points of time when the second and third torque addition processes are carried out may be set to be 120 degrees and 240 degrees, respectively, on the basis of the first torque addition process. Even in this case, it is possible to cancel the effect of the rotation speed of the drum at the time of starting the measurement by averaging the measurements performed three times, thereby calculating the weight of laundry received in the drum with high accuracy.

Also, the rotation angle of the drum at the second torque addition process may be set to be 240 degrees, and the rotation angle of the drum at the third torque addition process may be set to be 120 degrees, on the basis of the first torque addition process.

In this embodiment, the torque addition processes are continuously carried out twice while the uniform control of speed is performed therebetween. For example, another measurement may be carried out before n+0.5 rotations of the drum.

Specifically, when the torque addition processes are carried out four times, the third torque addition process may be carried out after n+0.5 rotations of the first torque addition process, and the fourth torque addition process may be carried out after n+0.5 rotations of the second torque addition process.

Consequently, it is possible to calculate the weight of laundry separately at two pairs of torque addition processes.

Also, n rotations of the drum may be performed between the torque addition processes, and n may be changed between the respective torque addition processes.

Although a few embodiments of the present invention have been shown and described, it would be appreciated by those skilled in the art that changes may be made in this embodiment without departing from the principles and spirit of the invention, the scope of which is defined in the claims and their equivalents.

As apparent from the above description, the present invention has the effect of canceling the unbalance due to the bias of laundry in the drum or the effect of the speed at the time of starting the measurement, thereby calculating the weight of the laundry within a very short time with high accuracy. Also, the present invention has the effect of performing control with high accuracy in connection with the amount of water injected or the unbalance correction at the spin-drying operation.

What is claimed is:

1. A drum type washing machine comprising a drum rotatably supported around a horizontal or inclined rotary shaft, a motor to rotate the drum, and a control mechanism to control the motor, wherein the control mechanism comprises:

a torque control unit to perform torque addition processes of adding pulse type torque during only a period for which the drum makes one rotation in a uniform torque control state in which torque of the motor is uniformly controlled k times (k is an integer not less than 2) and, at the same time, to set a rotation angle of the drum at points of time when the respective torque addition processes are carried out to be one obtained by equally dividing 360 degrees into k pieces; and a weight calculation unit to calculate an average value of rotational accelerations of the motor at the respective torque addition processes and, at the same time, to calculate a weight of laundry received in the drum based on the average value.

2. A drum type washing machine comprising a drum rotatably supported around a horizontal or inclined rotary shaft, a motor to rotate the drum, and a control mechanism to control the motor, wherein the control mechanism comprises:

a torque control unit to perform torque addition processes of adding pulse type torque during only a period for which the drum makes one rotation in a uniform torque control state in which torque of the motor is uniformly controlled at least two times and, at the same time, to perform the second torque addition process after n+0.5 rotations of the drum (n is an integer not less than 1) on the basis of the first torque addition process; and a weight calculation unit to calculate an average value of rotational accelerations of the motor at the respective torque addition processes and, at the same time, to calculate a weight of laundry received in the drum based on the average value.

3. The drum type washing machine according to claim 1, wherein the control mechanism alternately performs a uniform control of speed and a uniform control of torque, and the torque of the motor in the uniform torque control state is obtained by averaging torques applied to the drum during a period for which the drum makes one rotation immediately before the uniform control of torque is carried out.

* * * * *